United States Patent [19]

Manderla

[11] Patent Number: 4,492,358

[45] Date of Patent: Jan. 8, 1985

[54] TRUSS SHORING SYSTEM AND APPARATUS THEREFOR

[75] Inventor: Henry J. Manderla, Burlington, Canada

[73] Assignee: Anthes Equipment Limited, Mississauga, Canada

[21] Appl. No.: 286,277

[22] Filed: Jul. 23, 1981

[51] Int. Cl.[3] ..... E04G 11/40

[52] U.S. Cl. ..... 249/18; 249/28; 249/31; 249/47; 249/192

[58] Field of Search ..... 249/18, 28, 31, 47, 249/192

[56] References Cited

U.S. PATENT DOCUMENTS

| | | | |
|---|---|---|---|
| 3,239,188 | 3/1966 | Gastling | 249/18 |
| 3,414,228 | 12/1968 | Jennings | 249/18 |
| 3,787,020 | 1/1974 | Avery | 249/28 |
| 3,847,340 | 11/1974 | Ficken | 249/18 |
| 3,966,164 | 6/1976 | Dashew | 249/18 |
| 4,077,598 | 3/1978 | Marseillan | 249/18 |
| 4,106,256 | 8/1978 | Cody | 249/28 |
| 4,123,032 | 10/1978 | Teschner | 249/18 |
| 4,159,604 | 7/1979 | Burrell | 52/376 |
| 4,227,672 | 10/1980 | Cunningham | 249/28 |

FOREIGN PATENT DOCUMENTS

| | | |
|---|---|---|
| 941123 | 2/1974 | Canada . |
| 1501783 | 2/1978 | United Kingdom . |

*Primary Examiner*—John Parrish

*Attorney, Agent, or Firm*—Anthony J. Casella; Gerald E. Hespos

[57] ABSTRACT

The invention relates to a truss shoring method and an apparatus therefor utilized in the pouring of concrete floors and includes a plurality of unitary members adapted to provide vertically adjustable and horizontally movable primary modular units serving to support poured concrete.

3 Claims, 35 Drawing Figures

TRUSS SHORING SYSTEM AND APPARATUS THEREFOR

This invention relates to a truss shoring method and an apparatus therefor utilized in the pouring of concrete floors. Such systems and apparatus are already known and the latter basically consist of various braced structural members supporting wooden panels on to which the concrete is poured, such arrangements being termed structural units which, after the floor has set, are removed or "flown" to a higher position in the building being erected. However one disadvantage with these known arrangements has been among others, that the provisions for "rolling" the units out from under a poured and set floor to a position for "flying" have not, for one reason or another, proved to be too satisfactory. Another disadvantage has been that the integers of such units have not been too easily interchangeable so that quite large stocks of integers have had to be maintained. Hence, it is the object of the present invention to overcome the above disadvantages by providing a more universal system and apparatus directed to the pouring of concrete for the particular purpose just described.

The invention is illustrated, by way of example and diagrammatically, in the accompanying drawings, in which:

FIG. 1 is a side view of a basic modular truss-section;

FIG. 1*c* is a cross-section through the upper chord of a modular truss-section taken on the line 1*c*—1*c* of FIG. 2;

Figure 27:
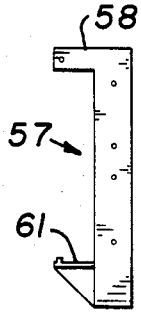
FIG. 27 is a side elevation of a positioning bracket.
Figure 28:
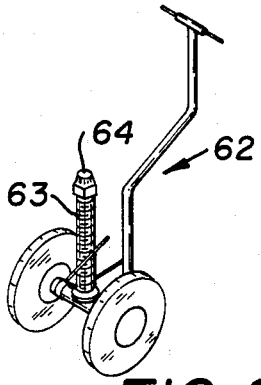
Figure 27A:
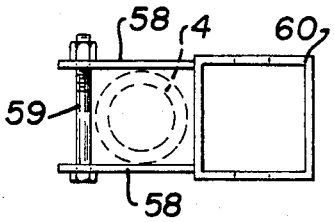
Figure 29:
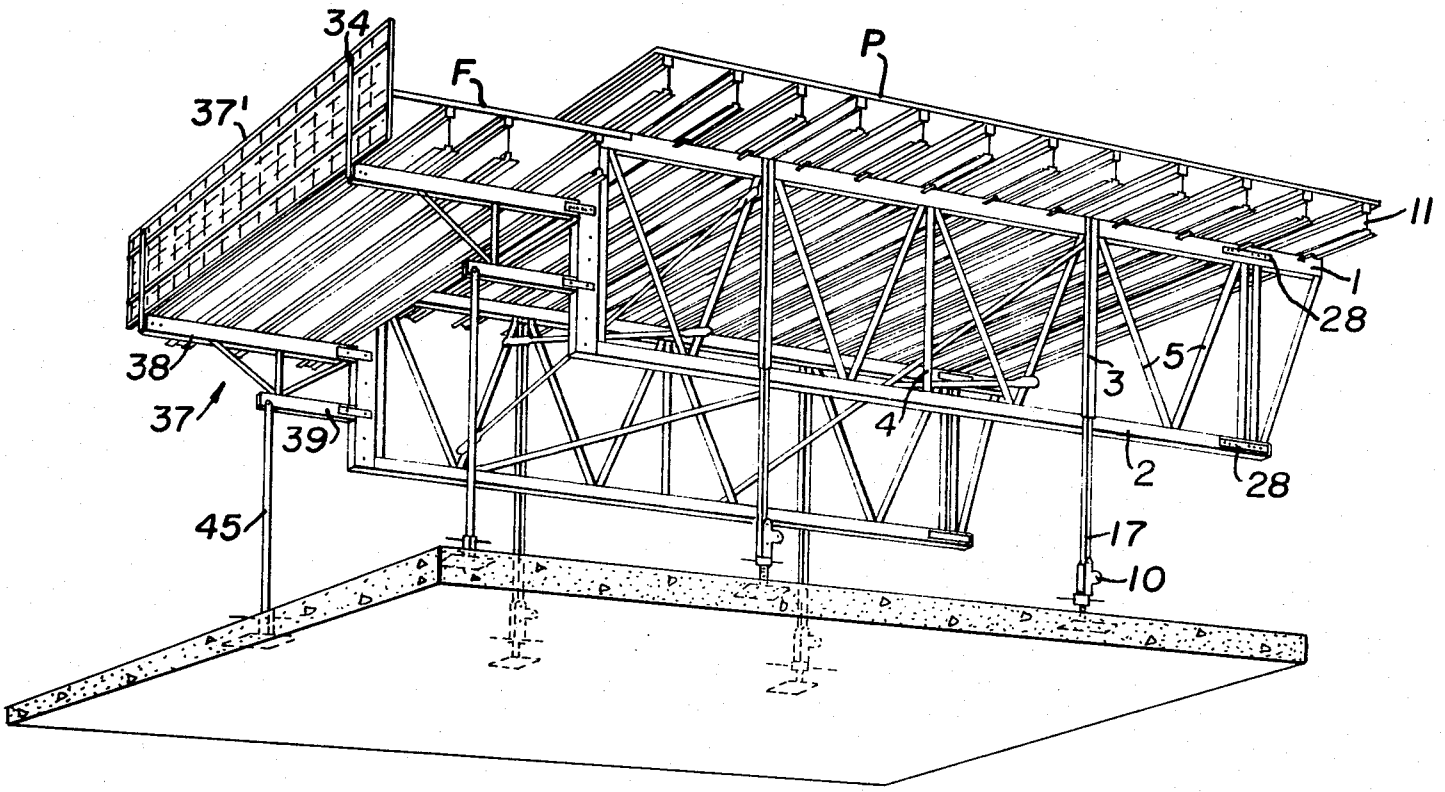
Figure 30:
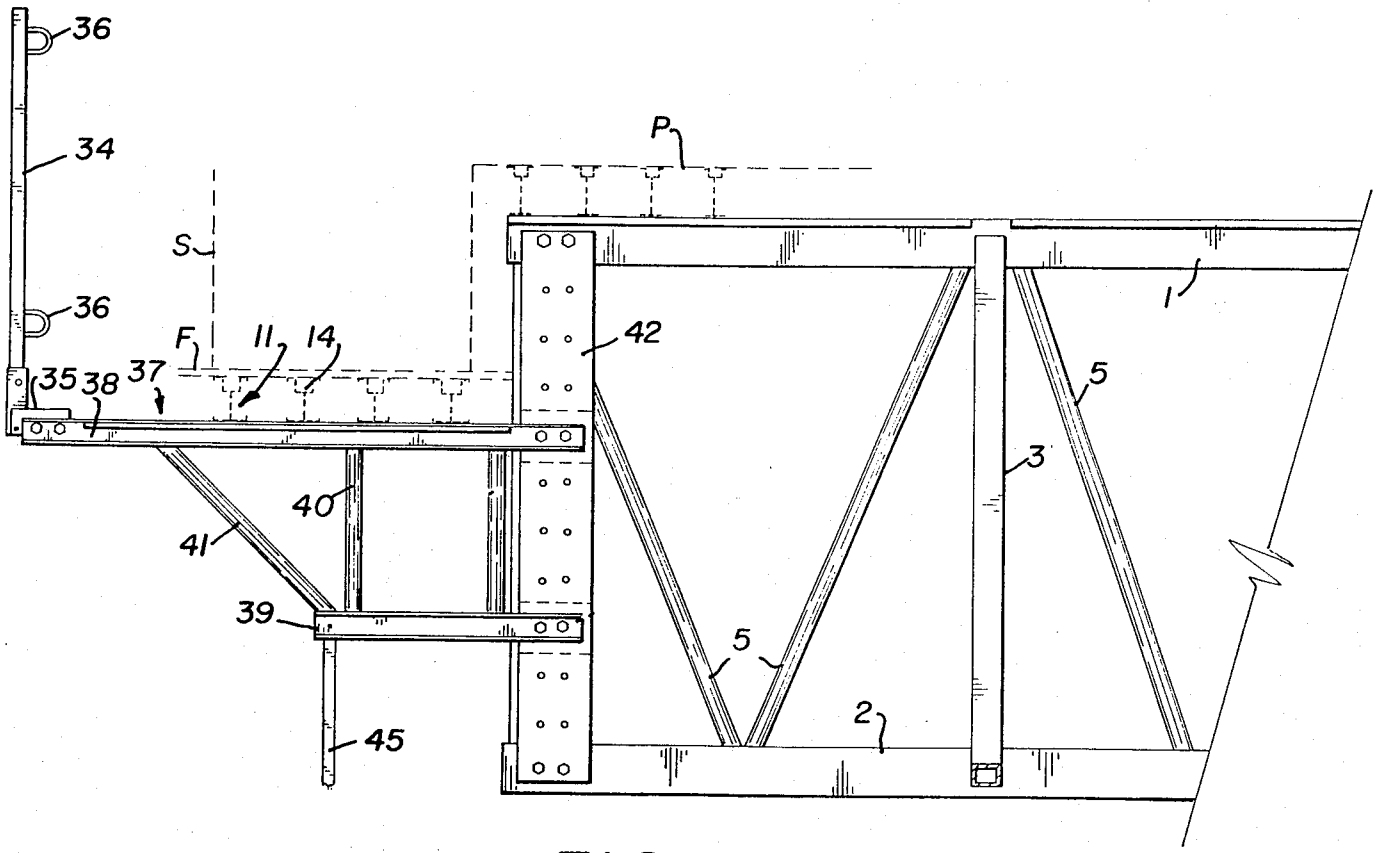
Figure 31:
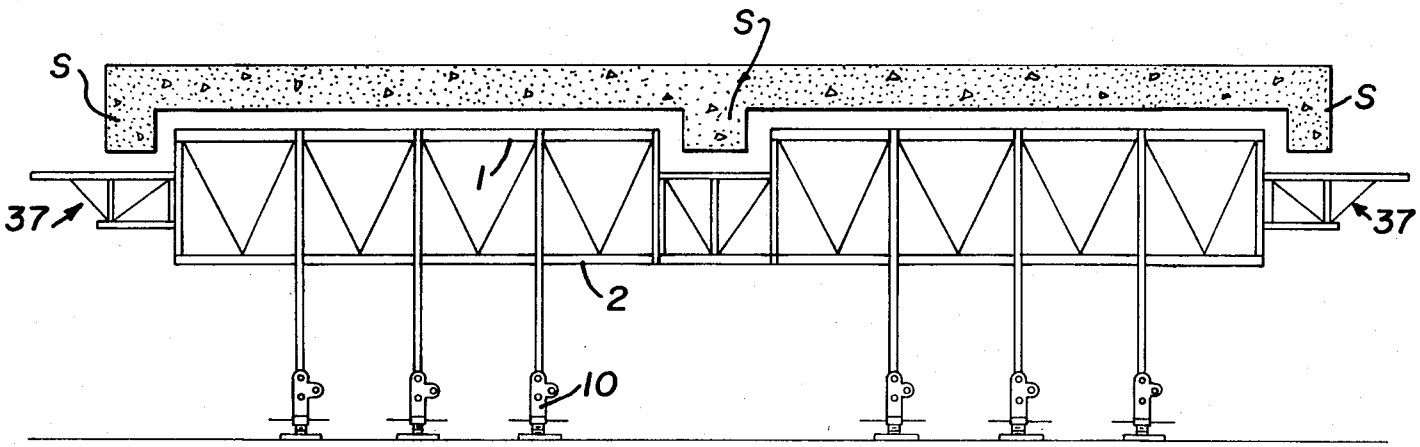
Figure 32:
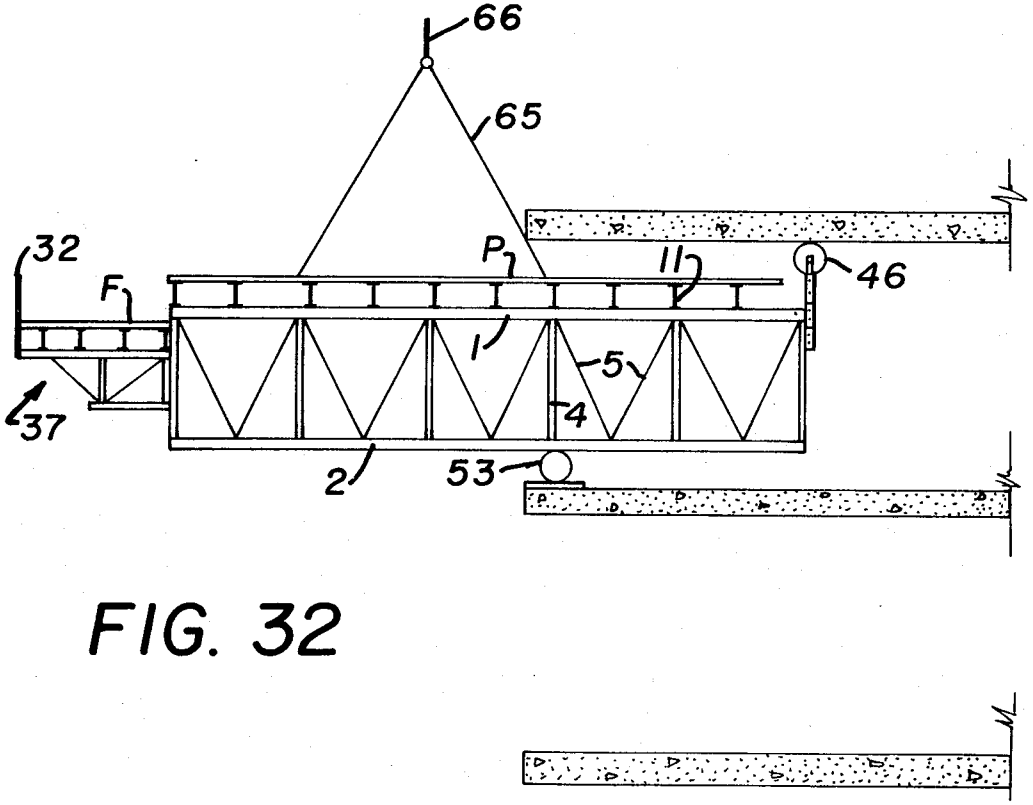
Figure 33:
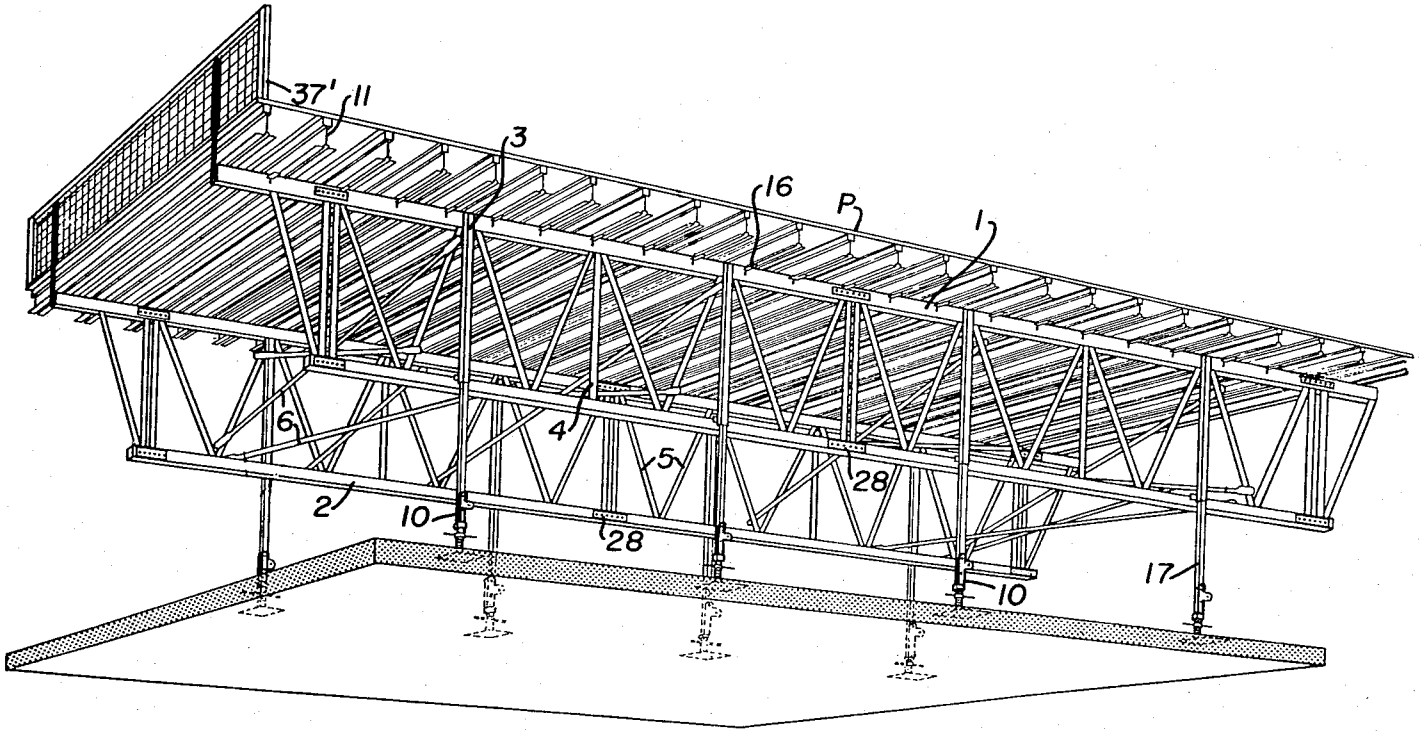

FIG. 27*a* is a plan view of FIG. 27;

FIG. 28 is a perspective view of a further positioning dolly;

FIG. 29 is a perspective view of a complete modular truss unit with a spandrel extension;

FIG. 30 is a diagrammatic view of a modular unit with a spandrel extension;

FIG. 31 is a diagrammatic view of a modular unit with a pair of mutually opposed spandrel extensions;

FIG. 32 is a diagrammatic view of a modular unit with a spandrel extension showing a phase in the "rolling" or "flying" operation of the unit; and FIG. 33 is a view similar to FIG. 29 but omitting the spandrel extension.

Figure 1:
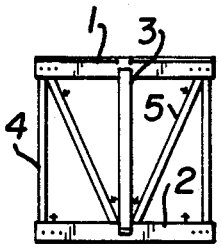
Figure 1C:
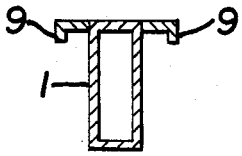
Figure 2:
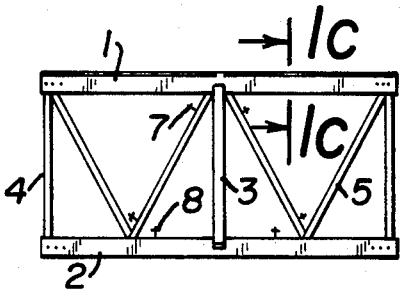
FIG. 2 is a side view of another modular truss-section.

Referring to the drawings, the invention includes a pair of substantially rectangular, interconnectable modular truss-sections each of which consist of vertically disposed pairs of upper and lower longitudinally extending truss chords 1, 2 each of hollow box-like cross-section spaced apart and connected by load-bearing members 3 also of hollow box-like cross-section extending vertically on the outer sides of said chords 1, 2 and longitudinally spaced tubular connectors 4 extending vertically between said chords each said member 3 being intermediate a pair of diagonally extending connecting members. Diagonal members 5 also connect the chords together at least one of said members 5 being located between each adjacent pair of members 3 and connectors 4. Cross-braces 6 also transversely connect the diagonal members 5 of one truss-section with those of the opposite truss-section through connection studs 7 carried by the members 5 and, if desired, also connect them together in a horizontal plane through connection studs 8 projecting upwardly from the lower chord 2. The upper chord 1 is, as will be seen from FIG. 1*c*, provided with a pair of side flanges 9 projecting from either side of its upper horizontal surface.

Figure 3:
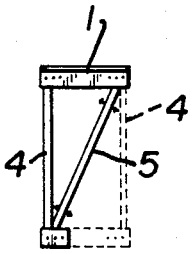
FIG. 3 is a side view of an end piece.

If desired, the end of each modular truss-section may be provided with an end-piece such as that shown in FIG. 3 and, as will be appreciated, the truss-sections of each module are connected in end-to-end (or longitudinal) relation by means of splice plates (FIGS. 17 and 18) bolted to the upper and lower chords 1,2 of a pair of end-to-end abutting truss-sections.

Figure 4:
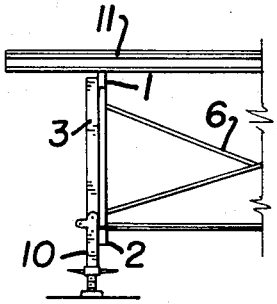
FIG. 4 is a part end view of an assembled modular truss-section.
Figure 5:
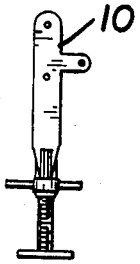
FIGS. 5 and 6 are, respectively, front and side elevations of a pivotable screw-jack.
Figure 6:
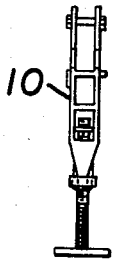

Load-bearing adjustable screw-jacks 10 (see FIGS. 5 and 6) are capable of being pivotally mounted to, and support, the lower ends of the load-bearing members 3 (see FIG. 4).

Figure 7:
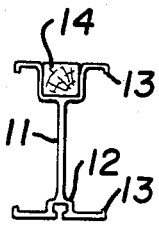
FIGS. 7–9 are end elevations of three forms of beams.
Figure 8:
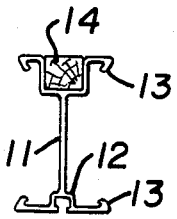
Figure 9:
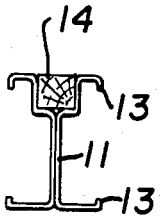
Figure 10:
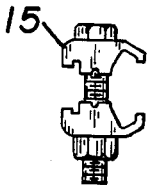
FIGS. 10 and 11 are side elevations of two forms of detachable clamps.
Figure 11:
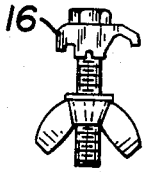

Beam members 11, FIGS. 7 and 8 (of the type described and claimed, respectively, in U.S. Pat. No. 4,159,604 which issued on Jan. 2nd, 1979 or in copending application Ser. No. 286,294 filed July 23rd 1981) having a lower T-shaped slot 12, stub flanges 13 and a wooden insert 14, are then secured to the upper surfaces of the upper truss chords 1 respectively by the type of clamps 15 or 16 shown in FIGS. 10 and 11 and which are described and claimed in copending application Ser. No. 286,089 filed July 23rd 1981. The beams may also be of the type which omit the slot 12 and which are shown in FIG. 9, such beams being described and claimed in British Pat. No. 1,501,783 which was published on Feb. 22nd 1978. The clamps secure the stub flanges 13 of beams 11 to the side flanges 9 of the upper chord 1.

The beams 11 are spaced apart throughout the length of the chords and extend transversely thereto. Plywood panels P (see FIGS. 29–33) are then detachably secured to the wooden inserts 14 by nails in order to receive the poured concrete.

Figure 13:
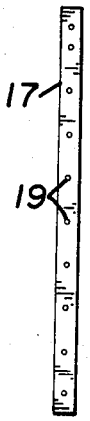
FIG. 13 is an elevation of an extensible leg.
Figure 14:
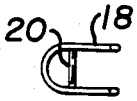
FIG. 14 is a side elevation of leg-connecting means.
Figure 16:
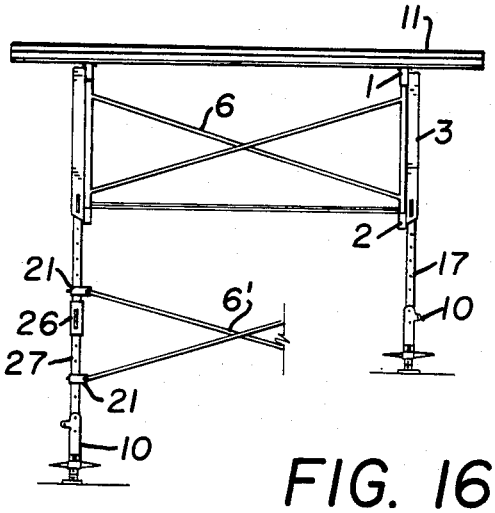
FIG. 16 is an end view of two forms of modular truss-sections.

Should the height of the modular truss-unit be insufficient, primary extension legs 17 of substantially box-like cross-section (FIG. 13) can be inserted in the lower ends of the load-bearing members 3 and maintained at the required height by means of open-ended U-bolts 18 (FIG. 14) passing through holes (not shown) provided in the lower ends of the load-bearing members 3 and holes 19 spaced throughout the length of said legs 17. The stirrup-bar 20 extending across each U-bolt 18 serves to define a hand-grip and also serves as a limiting stop to prevent said bolts 18 from being over-inserted into the cooperating and aligned holes in the legs. Screw-jacks 10 are positioned below the lower ends of the primary extension legs 17 to support the latter. The right hand side of FIG. 16 illustrates this arrangement.

Figure 12:
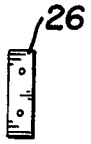
FIG. 12 is an elevation of a connecting sleeve.
Figure 15:
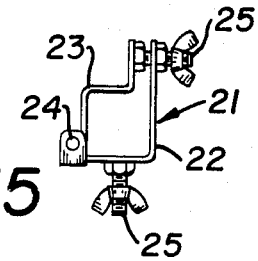
FIG. 15 is a plan view of a hingeable brace-clamp.

Should the height of the modular truss unit still be insufficient, connecting sleeves 26 (FIG. 12) of box-like cross-section are slidden on to the lower ends of the primary extension legs 17 and the upper ends of secondary extension legs 27 (FIG. 16) of substantially box-like cross-section are slid into the opposite ends of said sleeves 26 which are then bolted to each pair of primary and secondary legs 17,27 extending in aligned relationship. Vertically spaced pairs of hingeable clamps 21 (FIG. 15) are secured to each vertically aligned pair of legs 17,27, one on each said leg.

Each clamp includes a pair of members 22, 23 pivoted together at 24 and each having threaded means 25 projecting therefrom. In operation, the members 22, 23 are pivoted away from one another so as to permit the clamp to embrace a primary extension leg 17 and to be tightened thereon. Apertured ends of transverse and longitudinal cross-braces 6' (FIG. 16) are then secured to the clamps 21 by the threaded means 25. The screw-jacks 10 are then positioned below the lower ends of the secondary extension legs 27 to support the latter. The left hand side of FIG. 16 illustrates this arrangement.

Figure 17:
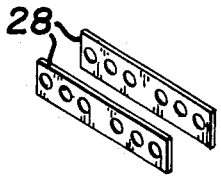
FIGS. 17 and 18 are perspective views of two forms of splicing or connecting plates.
Figure 18:
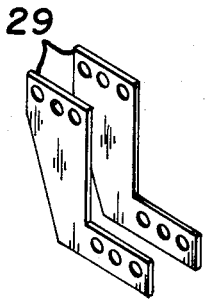

Longitudinally aligned modular truss-sections are connected together by pairs of upper and lower splice plates 28 (FIG. 17).

Figure 19:
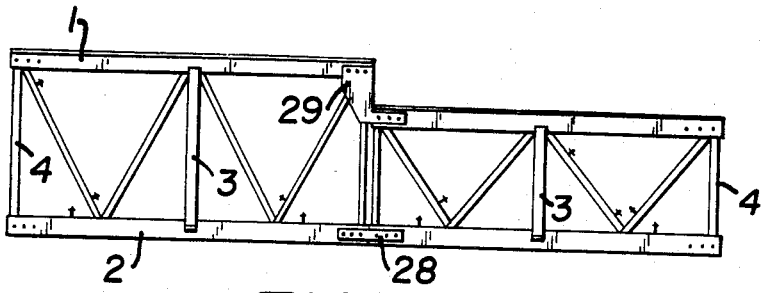
FIG. 19 is a side view of an alternate modular truss-section.

In cases where the underside of the floor to be poured is non-planar, longitudinally aligned modular truss-sections of different heights must be employed. However, in this case, whereas the lower chords 2 will be longitudinally aligned, the upper chords 1 will not, so that angled or drop splice plates 29 (FIG. 18) must be employed to connect said aligned sections together and such an arrangement of truss-sections is shown in side view in FIG. 19.

Figure 20:
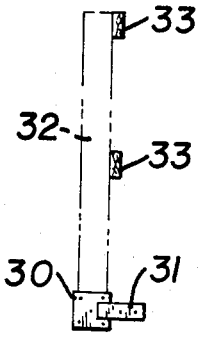
FIGS. 20 and 21 are side views of alternative forms of fence posts to which a safety fence may be anchored.
Figure 21:
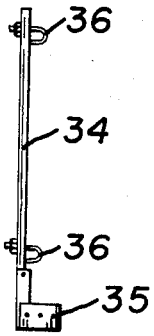
Figure 23:
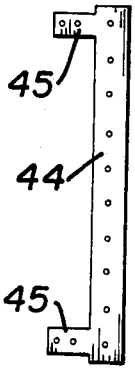
FIG. 23 is a side elevation of a connecting bracket.

Obviously, and for safety purposes, a safety fence must be provided in order to prevent workers from falling. This can be achieved in two ways. The first is to provide fence post brackets 30 (see FIG. 20) of box-like cross-section secured to extensions 31 which are adapted to be placed alongside outer ends of the upper chords 1 and bolted thereto. The brackets 30 are adapted to receive and support vertical timber posts 32 to which horizontal timber rails 33 are attached and which extend from at least one side of a truss-unit to the other. The second alternative, is to provide vertical steel posts 34 (FIG. 21) which, at their lower ends, are hingeably connected to extensions 35 capable of being slidden into the outer ends of the upper chords 1 and bolted thereto. Each post 34 carries at least a pair of vertically spaced hoops 36 to which a pre-formed mesh safety frence 37 (see FIGS. 29 and 33) can be detachably secured, such a type of fence being described and illustrated in U.S. Pat. No. Re. 28,493 which issued on July 24, 1975.

Figure 22:
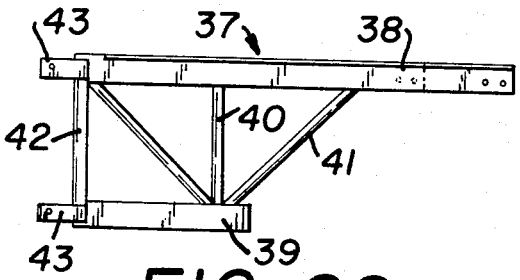
FIG. 22 is a side elevation of a spandrel extension.

Often as not, the spandrel i.e. the perimeter of a floor, requires some form of special attention such as, for example, a depth which is greater than the depth of the general area of the floor, such depth depending from the floor and requiring special formwork prior to the concrete being poured. Obviously, such formwork must be erected from special staging and, heretofore, this has been separate from the "flying" unit and has involved much time and effort. However, the present invention overcomes such problems in a quick and relatively easy manner. With prior knowledge that a portion, or all of a perimeter of a floor will require a greater depth than the remainder of the area of the floor, the unit is provided with an adjustable spandrel extension indicated generally at 37 in FIG. 22 and a spandrel connector 44 (FIG . 23).

The extension, indicated generally at 37, projects from one end of the modular truss unit and includes pairs of vertically disposed upper and lower chords 38, 39 spaced apart by vertical side members 40 each of the latter being disposed between a pair of diagonal side braces 41. Preferably, the overall length of each lower chord 39 is less than that of the upper chords, 38 and the upper surface of the latter is provided with side flanges 9' (see FIG. 30).

The inner ends of the upper and lower chords 38, 39 of hollow box-like cross-section are provided with pairs of said plates 42 welded at one end thereof to the innermost side member 40.

Each pair of plates 42 is adapted to embrace an associated vertically extending and bored connector 44 of hollow box-like cross-section and provided with horizontally extending stub extensions 45. Bolts 43 are adapted detachably and adjustably to secure the side plates 42 to the connectors 44 and the extensions 45 are adapted to project into the upper and lower primary chords 1,2 of the modular truss unit. The extensions 45 are retained in situ within the chords 1,2 by bolts 45' passing through holes 77 (FIG. 35) in the extensions and corresponding holes (not shown) formed in the sides of said upper and lower chords 1,2.

It will thus be apparent that the spandrel extension 37 is vertically adjustable on the connectors 44 so that its upper horizontal surface can be varied in relation to the upper horizontal surface of the adjacent and connected modular truss unit.

A plurality of cross-beams 11 such as, for example, those described and claimed in British Pat. No. 1,501,783 published Feb. 22nd, 1978 or that shown in U.S. Pat. No. 4,159,604 which issued on July 23rd 1979 or those shown in FIGS. 7–9 herewith (all of which beams include wooden inserts to which the plywood panels P can be nailed) are placed in spaced relation to one another and extend from one upper chord 38 of the spandrel extension to the other in order to support the staging required to pour the spandrel S. Obviously, the free portion of the plywood panels P (to the left as viewed in FIG. 30) forms a walkway W which will support a number of workmen and the ancillary equipment required in the pouring of a spandrel S which projects and depends from the outer perimeter of the floor F and which is of greater depth than the latter.

The extension 37 is also capable of bearing vertically extending fence posts which serve to carry a safety fence as will be described hereinafter. Moreover, and if desired, the lower chords 39 may carry detachable or integral hingeable vertical supports 45' and the lower ends of the latter may be supported by any suitable and vertically adjustable jack means.

Referring now to FIG. 31, it will be seen that a pair of modular truss-units (with the beams and attendant integers omitted for greater clarity) is connected by a filler panel indicated generally at FP and each unit is provided with spandrel extension 37 at its end remote from said panel FP.

As will be appreciated from reference to FIGS. 29–32 the workers can stand on the walk-way F to erect the forming required to pour the spandrel S (See FIGS. 30 and 31).

If required, the spandrel extension 37 can be provided with separate or integral and pivotally mounted leg support means 45 (FIGS. 29 and 30) supported at the lower end by any suitable jack means and being capable of vertical adjustment.

Figure 24:
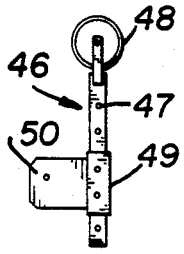
FIG. 24 is a side elevation of a ceiling roller and bracket.

FIG. 24 illustrates what is termed as a ceiling roller assembly, indicated generally at 46, employed in "rolling" the modular unit in a longitudinal horizontal plane and as will be described hereinafter. It will be seen that the assembly 46 includes a vertically adjustable support 47 the upper end of which carries a roller 48, the support 47 being mounted in a holder 49 having an ear 50 capable of insertion in the open end of the top chords 1 of the truss-unit.

Figure 25:
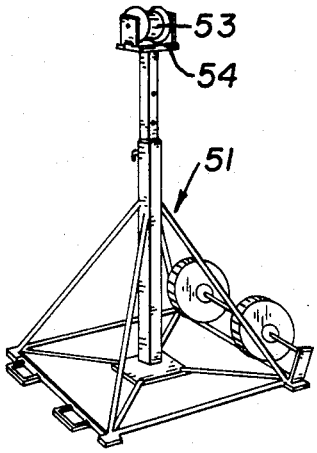
FIG. 25 is a perspective view of a truss-supporting dolly.

FIG. 25 shows a wheeled roll-out stand or dolly indicated generally at 51 (and employed in "rolling" of a modular unit) which includes vertically adjustable support means 52 the upper end of which carries detachable roller means 53 (shown more clearly in FIG. 26) mounted on a base plate 54 having a pair of holes 55,56 of different diameters.

FIG. 27 shows a support bracket, indicated generally at 57, utilized in the moving of modular unit in a transverse horizontal plane. The bracket 57 includes a pair of spaced upper cheeks 58 (see FIG. 27*a*) adapted to embrace a vertical tubular connector 4 and to be detachably secured in this operative position by means of nuts and bolts 59 as well as a vertically extending body portion 60 of hollow box-like cross-section carrying a lower support plate 61. The support bracket 57, as will be described hereinafter, is adapted to operate in conjunction with the wheeled dolly indicated generally at 62 in FIG. 28 which is provided with a vertically adjustable support column 63 having an upper end 64.

After the floor has been poured, and the concrete set, it is then necessary to remove the unit from beneath the poured and set floor and to "fly" it to a higher location by a crane in order that a further floor may be poured upon it. Before "flying" however, the unit must be "rolled" outwardly so that it projects a predetermined distance beyond the perimeter of the floor so that a crane can be connected to it. However, before "rolling" can occur, the height of the unit has to be reduced. This is done in various ways, through the use of hydraulic or mechanical jacks etc; as will now be described. The procedure is slightly different, depending upon whether the screw-jacks 10 are pivotally mounted to the lower ends of the load-bearing members 3, or support the lower ends of the primary extension legs 17, or support the lower ends of the secondary extension legs 27 and whether the three types of unit just described are provided with one or more spandrel extensions 37. Accordingly, the sequential steps of the rolling-out and flying procedures comprise:

(i) Unit without extension legs (a) placing at least two hydraulic jacks of any suitable low-rise type (not shown) beneath the lower chords 2 of the modular unit and supporting the latter thereon;

(b) securing the inner end of the unit to any suitable location by means of cables (not shown) and known in the trade as tie-back or safety lines, in order to ensure that the unit is not rolled outwardly too far;

(c) slackening the jacks 10 (pivotally mounted to the lower ends of the load-bearing 3), pivoting them upwardly and thereafter securing them in their non-operative position in any suitable manner;

(d) placing at least four rollers 53, two either side, under the lower chords 2;

(e) causing the hydraulic jacks to lower the modular unit until it is supported on said rollers 53; and (assuming that the ceiling roller assemblies 46 are not utilized);

(f) pushing the unit outwardly from the building until it approximately reaches its fulcrum-point where slings 65 are placed around the upper chords 1 and connected to the cable 66 of a crane whereupon said unit is pushed (or "rolled") fully outwardly where the crane will "fly" the unit upwardly to a higher location.

It is possible, of course, that the particular shape of the building will require the utilization of the ceiling roller assemblies 46 as will now be described. The use of such assemblies ensures that the poured and set floor immediately above the modular unit will not be damaged during a rolling operation and, moreover, will permit the modular unit to be rolled out, without tipping, beyond its fulcrum-point due to the surface engagement between the ceiling rollers 48 and the underside of said poured and set floor. If the use of the assemblies 46 is required, then an additional step (e') will be required i.e.

(e') inserting each 50 of each assembly 46 into the open inner end of each upper chord 1.

Thus, a rolled-out unit, using assemblies 46, is shown diagrammatically in FIG. 32.

(ii) Unit with primary extension legs (a) placing at least two hydraulic jacks of any suitable high-rise type beneath the lower chords 2 of the modular unit and supporting the latter thereon;

(b) placing at least four roll-out stands 51 under the lower chords 2 at predetermined locations and at pre-set elevations;

(c) slackening the jacks 10 supporting the primary extension legs 17 and removing and securing them in any suitable location on the modular truss unit;

(d) removing the U-bolts 18 connecting the primary extension legs 17 to the load-bearing members 3 and pushing the legs 17 upwardly until they are contained within the load-bearing members 3 when said bolts 18 are re-inserted to retain said legs 17 in their inoperative position;

(e) if the type of dolly 51 is not employed, placing at least four rollers 53 (FIG. 26), two either side, under the lower chords 2;

(f) causing the hydraulic jacks to lower the modular unit until it is supported on said rollers 53;

(g) if the ceiling roller assemblies 46 are employed, inserting the ears 50 of said assemblies into the open inner end of each upper chord 2;

(h) securing the inner end of the unit to any suitable location by means of a tie-back or safety line; and (i) pushing the unit outwardly and flying it in accordance with step (f) of method (i) described above.

Figure 26:
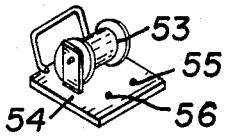
FIG. 26 is a perspective view of a floor roller.

It will be appreciated that step (e) of method (ii) will not be required if floor rollers of the type shown in FIG. 26 are employed because the lower chords 2 will be sitting on the rollers 53 thus enabling the unit to be rolled outwardly on said floor rollers, the use of which depends upon the height between the two adjacent floors and any possible obstructions in the roll-out path. Quite obviously, in making use of the said step (e) a distinct saving in man-power time will be achieved.

(iii) Unit with both primary and secondary extension legs

The height between the two adjacent floors dictates whether primary extension legs 17, each having at least one secondary extension leg 27, are used. However, when such legs are used, the height is too great for the utilization of the high-rise hydraulic jacks so that the lowering procedure is different i.e. the modular unit is supported from above through the intermediary of winches located on the floor above and cooperating cables passing through holes formed in said floor and fastened to the truss unit. The holes are constituted by sleeves around which the concrete of the upper of two floors is poured during a pouring operation and the winches are placed in position on said upper floor when the latter has set. The lowering procedure would then include the following steps:

(a) Securing the winch cables to the upper chord 1 of the modular truss unit;

(b) removing the pivot jacks 10 supporting the lower ends of the secondary extension legs 27 and securing said jacks 10 to the truss unit;

(c) removing the cross-braces 6', clamps 21, sleeves 26 and secondary extension legs 27;

(d) removing the U-bolts 18 connecting the primary extension legs 17 to the load-bearing members 3 and pushing said legs upwardly until they are contained within said members 3 when said bolts 18 are re-inserted to retain the legs 17 in their inoperative position;

(e) either placing roll out stands under the lower chords 2 of the unit or the floor rollers 53 (FIG. 26) on the floor under said chords;

(f) lowering said modular unit, by means of the winches, down on to said dollies or the said floor rollers 53;

(g) inserting the ceiling roller assemblies 46 (if required) into the open inner ends of the upper chords 1 of the truss unit;

(h) securing the inner end of the unit to any suitable location by means of tie-backs or safety lines;

(i) disconnecting the winch cables from the truss unit; and (j) pushing the unit outwardly and flying it in accordance with step (f) of method (i) described above.

If, due to a projection depending from the underside of the upper floor, it is required to move a truss unit sideways or transversely in a horizontal plane prior to a rolling-out operation, this can be achieved by the use of the dolly 62 shown in FIG. 28 and the positioning of such a dolly depends upon whether primary extension legs 17 are used or not.

Assuming that primary extension legs 17 are not employed and it is required to move the truss-unit sideways, support brackets 57 are detachably secured to the tubular connectors 4 with the support plates 61 located beneath the lower chords 2, whereby, after the jacks 10 have been pivoted upwardly and secured in their non-operative position, dollies 62 can be positioned beneath the brackets 57 and vertically adjusted until their upper ends 64 are accommodated within the open lower ends of said brackets 57. Thus, as the wheeled dollies 62 are moved. the truss unit will follow due to being supported by said dollies.

Alternatively, and assuming the primary extension legs 17 are employed and have been slidden upwardly and secured within the load-bearing members 3, the dollies 62 can be positioned beneath the open ends of said legs 17 and vertically adjusted until their upper ends 64 are accommodated within said open ends and thereby support the modular truss unit for sideways movement.

Finally, it is to be noted from the drawings that the diagonal members 5, of each associated pair thereof, extend downwardly towards one another and to their point of connection with the lower chord 2, either from adjacent the upper end of a vertical load-bearing member 3 or from an adjacent upper end of a tubular connector 4. This means that the modular truss unit can be supported at the points of intersection of said members 3 and connectors 4 with the lower chord 2, as well as at the points of intersection of the diagonals 5 with said chord 2, said points preferably being 2'–6" apart. This is distinctly advantageous over known prior art where the load-bearing members are spaced 5'–0" and 10'–0" apart and the diagonals meet at their point of intersection with one another as well as their intersection with the upper chord. This is distinctly advantageous because of the whip and play of the prior art units during "rolling out" operations due to the great distance between the lower connection points and particularly when such a unit assumes the position such as that of the instant invention in FIG. 32.

The present invention is also advantageous in that in the arrangement shown and described above, the substantially rectangular truss sections permit the modular truss units formed thereby to be spliced together at their extremities whereas, in at least one known arrangement, the units are spliced together at mid-span because the sections are substantially parallelogram shaped due to the chords being of different lengths.

Moreover, as the load-bearing members 3 of the present invention are of box-like cross-section, as opposed to known art, where they are of I-beam construction, the unit is much stronger and has a greater rigidity.

I claim:

1. A flying truss utilized in the pouring of concrete floors, said flying truss being for use with jacks for raising and lowering said flying truss and with form means into which the concrete may be poured said flying truss including:

(a) a pair of spaced and braced substantially rectangular interconnectable modular truss sections connected together to form a structural unit, each said section at least including:

(i) a pair of upper and lower longitudinally extending chords, the upper chords being adapted to support the form means;

(ii) at least a pair of longitudinally spaced vertically extending connectors serving to connect and space said chords apart, (iii) at least one vertically extending load-bearing member of substantially hollow, box-like cross-section, intermediate said pair of vertical connectors, secured to the side faces of said chords and also serving to connect and space said chords apart, the connection of said vertically extending load bearing member and said lower chord defining a support point for one of said jacks; and (iv) a pair of diagonally extending members located between an associated pair of vertical connectors and load-bearing members; the first diagonal member of each said pair thereof being connected at its upper end to the upper chord adjacent the upper end of an associated said connector and the second diagonal member of each said pair thereof being connected at its upper end to said upper chord adjacent the upper end of an associated said load-bearing member; the diagonal members of each said pair thereof extending downwardly from their said upper connections towards one another where their lower ends are connected to said lower chord intermediate said associated pair of vertical connectors and load-bearing members, said lower connections being capable of serving, when required, as additional support points for said jacks.

2. A flying truss according to claim 1 including a detachable extension leg of substantially box-like cross-section slidably mounted in each said load-bearing member.

3. A flying truss according to claim 1 wherein each said screw-jack is pivotally mounted on an associated said load-bearing member adjacent its lower end, and is capable of being pivoted out of its normal operative position below said load-bearing member and locked in an inoperative position.

* * * * *